US007352657B2

(12) United States Patent
O'Neill

(10) Patent No.: US 7,352,657 B2
(45) Date of Patent: Apr. 1, 2008

(54) MAZE LOCK HANGER

(75) Inventor: Terrence John O'Neill, Lake Geneva, WI (US)

(73) Assignee: Quartex, a division of Primex, Inc., Lake Geneva, WI (US)

( * ) Notice: Subject to any disclaimer, the term of this patent is extended or adjusted under 35 U.S.C. 154(b) by 968 days.

(21) Appl. No.: 10/068,239

(22) Filed: Feb. 5, 2002

(65) Prior Publication Data

US 2002/0154573 A1 Oct. 24, 2002

Related U.S. Application Data

(60) Provisional application No. 60/270,546, filed on Feb. 21, 2001.

(51) Int. Cl.
*A04F 7/24* (2006.01)

(52) U.S. Cl. ..... 368/327; 211/103; 248/114; 248/115; 248/551

(58) Field of Classification Search ..... 248/447.1, 248/231.91, 115, 27.1, 181.1, 301, 551–553, 248/114, 489; 211/4, 8, 86.01, 87.01, 95, 211/106.01, 103, 113, 117, 123; 968/160, 968/70; 368/276, 316, 327; D6/373
See application file for complete search history.

(56) References Cited

U.S. PATENT DOCUMENTS

| | | | | | |
|---|---|---|---|---|---|
| 358,193 | A * | 2/1887 | Gause | 248/114 |
| 659,396 | A * | 10/1900 | Hill | 368/44 |
| 845,423 | A * | 2/1907 | Landt | 248/114 |
| 1,045,227 | A * | 11/1912 | Wells | 248/115 |
| 1,092,020 | A * | 3/1914 | Cavey | 248/115 |
| 1,309,865 | A * | 7/1919 | Milne | 248/115 |
| 1,343,363 | A * | 6/1920 | Hall | 211/74 |
| 1,495,485 | A * | 5/1924 | Jersemann | 248/301 |
| 1,579,763 | A * | 4/1926 | Hammond | 248/115 |
| 1,665,491 | A * | 4/1928 | Clark | 248/27.1 |
| 1,720,740 | A * | 7/1929 | Miller et al. | 248/115 |
| 3,620,376 | A * | 11/1971 | Gingher | 211/123 |
| 4,074,888 | A * | 2/1978 | Garner | 248/475.1 |
| 4,190,221 | A * | 2/1980 | Updike | 248/551 |
| 4,326,689 | A * | 4/1982 | Edel et al. | 248/692 |
| 4,460,147 | A * | 7/1984 | Macbain | 248/542 |
| 4,473,316 | A * | 9/1984 | Welch | 403/246 |
| 4,557,457 | A * | 12/1985 | Cockfield et al. | 248/544 |
| 4,856,253 | A * | 8/1989 | Jou | 52/718.05 |
| 5,102,081 | A * | 4/1992 | Barchus | 248/181.1 |
| D346,952 | S * | 5/1994 | Keller | D8/373 |
| 6,240,182 | B1 * | 5/2001 | Gillett et al. | 379/435 |
| 2005/0082453 | A1 * | 4/2005 | Chuang | 248/300 |

* cited by examiner

*Primary Examiner*—P. Austin Bradley
*Assistant Examiner*—Jeanne-Marguerite Goodwin
(74) *Attorney, Agent, or Firm*—Michael Best & Friedrich LLP

(57) ABSTRACT

A hanger for mounting an object on a surface such as a wall. The hanger includes a slot that receives a projection such as a nail extending from the wall. The slot is nonlinear and provides an entry path through which the projection travels to reach its mounting position. The hanger also includes slot branches extending from the slot, which together with the slot create a maze through which the projection travels when the object is attempted to be removed from the wall. The slot branches provide dead end paths that the projection may encounter when the object is attempted to be removed from the wall.

18 Claims, 7 Drawing Sheets

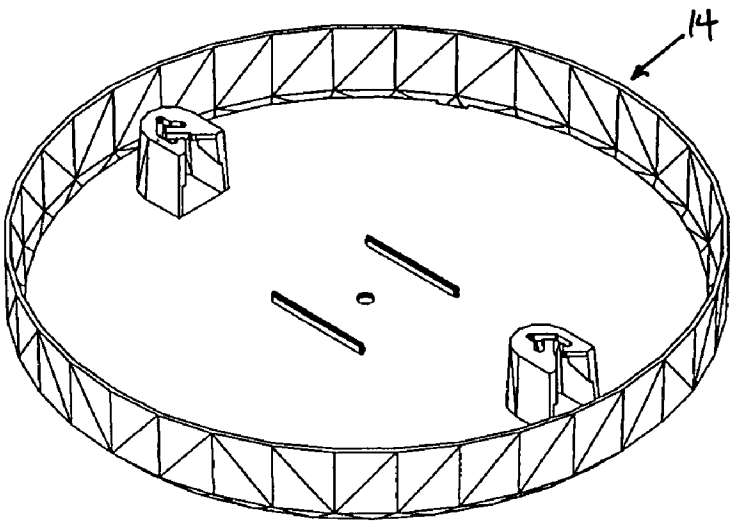
FIG. 6
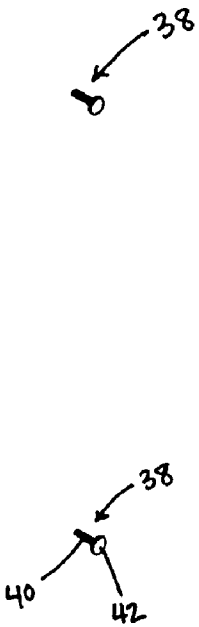

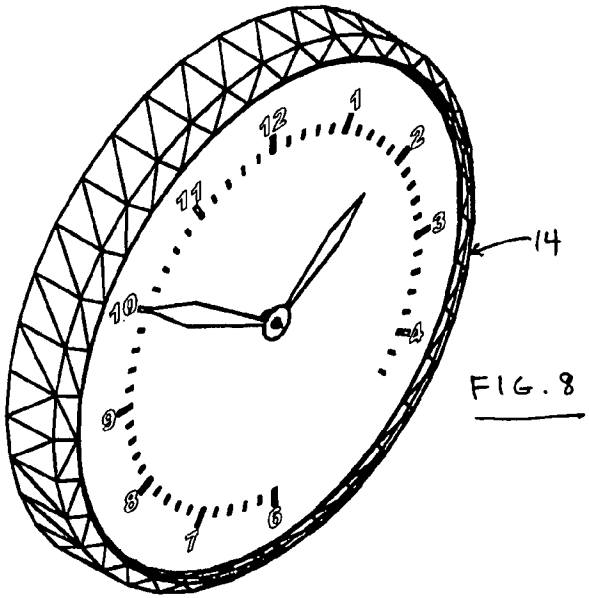
FIG. 8
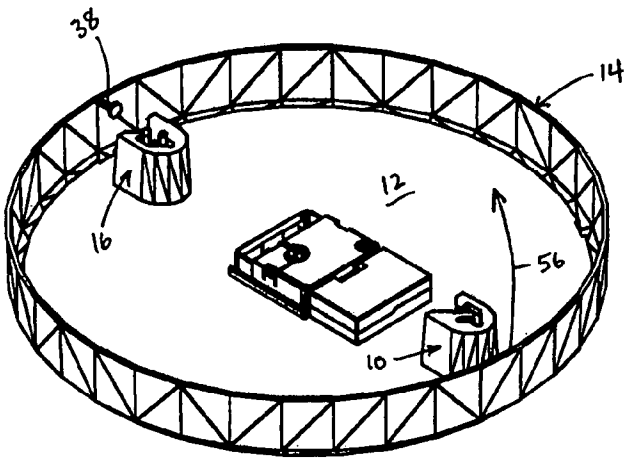
FIG. 7
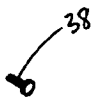

MAZE LOCK HANGER

CROSS-REFERENCE TO RELATED APPLICATIONS

This application claims priority under 35 U.S.C. § 119 to provisional patent application No. 60/270,546 filed Feb. 21, 2001.

BACKGROUND AND SUMMARY OF THE INVENTION

The invention relates to an apparatus for supporting an object on a substantially vertical surface, such as a wall, and more particularly to a hanger for supporting an object by engaging a projection on such a surface.

Theft or accidental removal of objects (e.g., clocks and other electronic equipment) is often a problem in hotels and other such facilities. The loss or potential loss of items has prompted many public and private institutions to take extra steps to prevent such loss. These extra steps can add additional costs for materials and installation. Furthermore, any additional equipment used to prevent theft often impairs necessary access to the items themselves. The impaired access increases the cost for required maintenance, adjustment, repair, or battery replacement.

In the case of battery-operated devices where yearly battery replacement is recommended, or in the case of clocks where daylight savings time or periodic time keeping adjustments are required, the additional access time can add significantly to the cost of maintenance. Furthermore, visible anti-theft devices, such as covers, cages or locks, may give an impression of an unsafe environment. Even in safe environments, where theft may not be a concern, occasionally objects that are hung on a wall will be bumped by an individual or even jarred by an earthquake or other circumstance, which causes the objects to fall off the wall and be damaged or destroyed.

Therefore, a device that provides hidden protection against accidental or mischievous removal of wall-mounted objects, while still providing easy installation, access, and purposeful removal of the object would be welcomed by users of such objects.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 6 is a view similar to FIG. 1 showing the clock and two projections from a surface to which the clock is to be mounted;

FIG. 7 is a view similar to FIG. 6 showing the clock in a first mounting position relative to the two projections;

FIG. 8 is a perspective view showing the clock in a second mounting position wherein the clock has been rotated 90° up against the surface and is mounted on the projections.

DETAILED DESCRIPTION OF THE DRAWINGS

Figure 1:
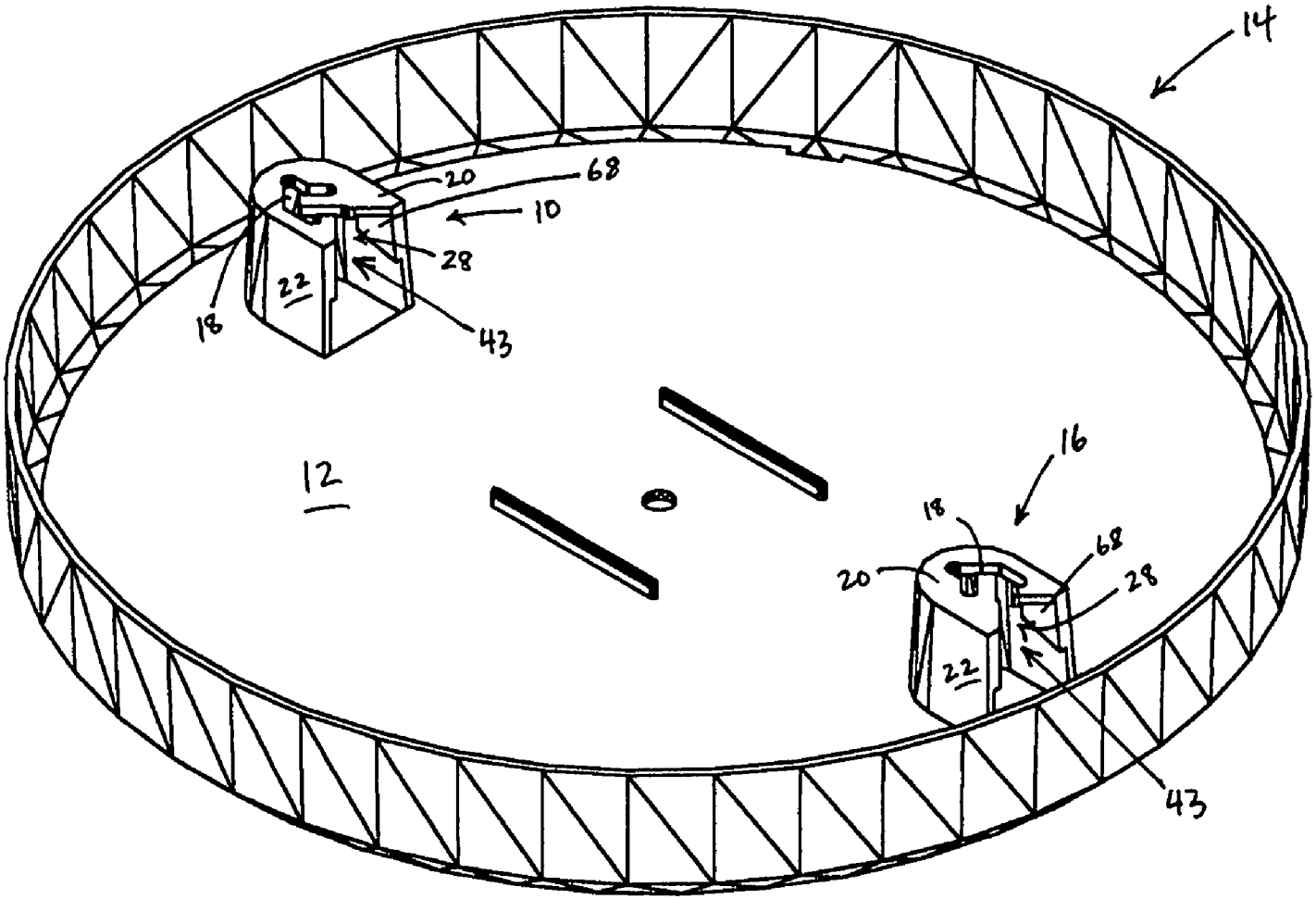
FIG. 1 is a perspective view of a back face of a clock molded to include a top and bottom maze lock hanger, each in accordance with the present invention.

Referring to FIG. 1, a top maze lock hanger 10 in accordance with the present invention is shown mounted to a back face 12 of a clock 14. In addition to the top maze lock hanger 10, the clock 14 further includes a bottom maze lock hanger 16 in accordance with the present invention. Although the clock 14 of FIG. 1 is shown with both the top maze lock hanger 10 and the bottom maze lock hanger 16, according to the present invention, an object such as the clock 14 may include only one maze lock hanger or more than the two maze lock hangers shown in FIG. 1.

Figure 2:
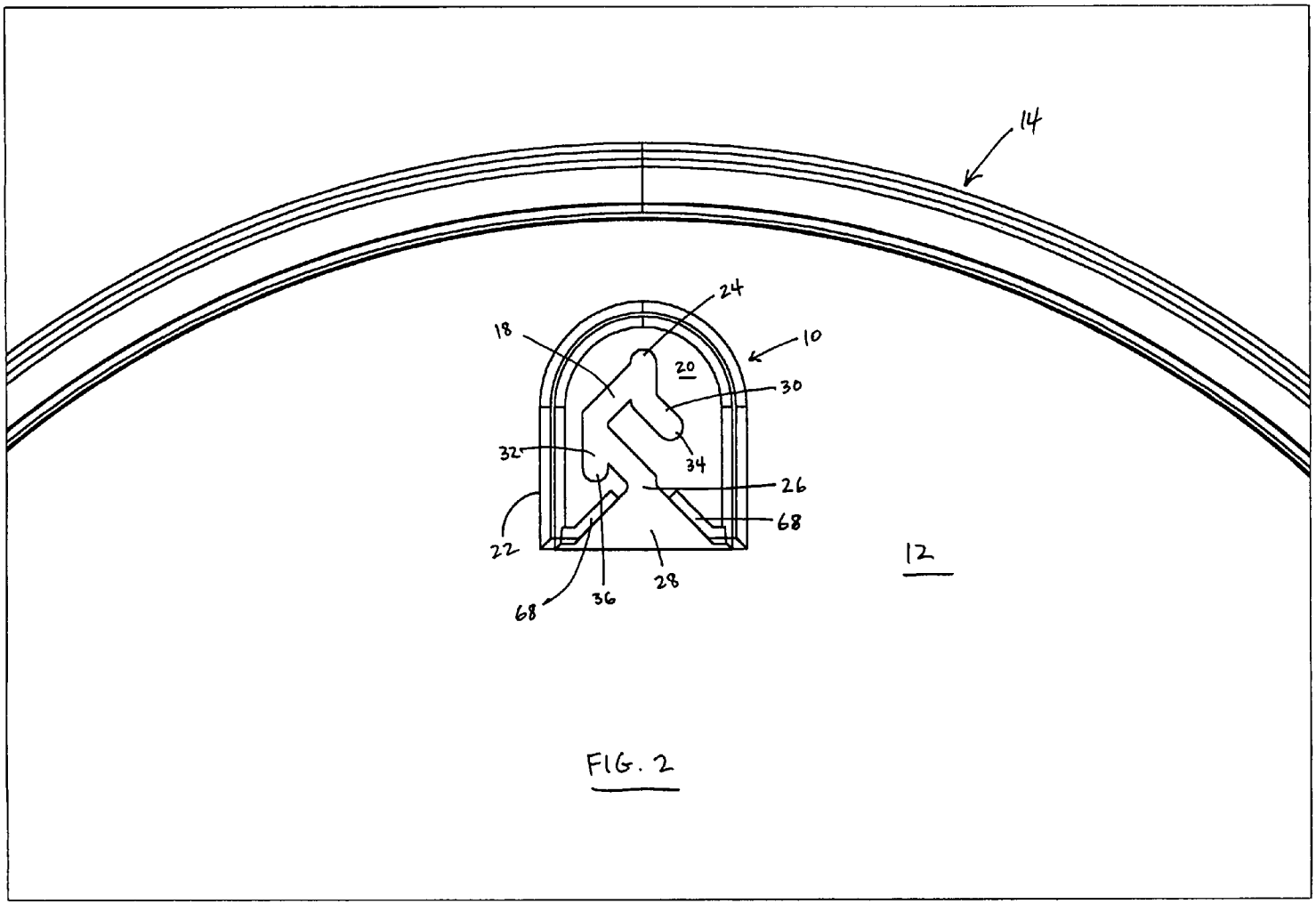
FIG. 2 is a magnified, plan view of the top maze lock hanger of FIG. 1.

Referring to FIG. 2, the top maze lock hanger 10 includes a slot 18 cut into a face 20 raised off of the back face 12 of the clock 14 by a surrounding sidewall 22. However, according to the present invention, the slot 18 could be cut directly into the back face 12 of the clock 14. As will be further apparent below, the bottom maze lock hanger 16 includes nearly identical features to the top maze lock hanger 10. Therefore, like parts will be identified with like reference numerals. Still referring to FIG. 2, the slot 18 includes a first end 24 that is closed and a second end 26 that opens into a receiving area 28. Additionally, a first and second slot branch 30 and 32, respectively, diverge from the slot 18 and terminate in first and second dead ends 34 and 36, respectively.

As will be discussed in more detail with respect to FIGS. 6 through 9, the top maze lock hanger 10 and the bottom maze lock hanger 16 engage projections 38 (e.g., nails, screws, etc.; see FIG. 6) that project from a wall or other suitable surface for mounting a device, such as the clock 14. Each projection 38 includes a shaft portion 40 that is narrower than the width of the slot 18 and a head portion 42 that is wider than the width of the slot 18. As will be readily apparent to those of ordinary skill in the art viewing FIGS. 1 and 2, the head portion 42 of the projection 38 is positioned in the receiving area 28 and the shaft portion 40 of the projection 38 is then slid into the slot 18, so that the head portion 42 is captured in a chamber 43 behind the face 20 of the maze lock hanger 10. Because the slot 18 is narrower than the head portion 42 of the projection 38, the maze lock hanger cannot be pulled off the projection 38 in a direction along the axis of the projection 38. The way to remove the maze lock hanger 10 from the projection 38 is to back the projection 38 out of the slot 18 so that the head portion 42 is again in the receiving area 28 and free from the maze lock hanger 10.

Figure 3:
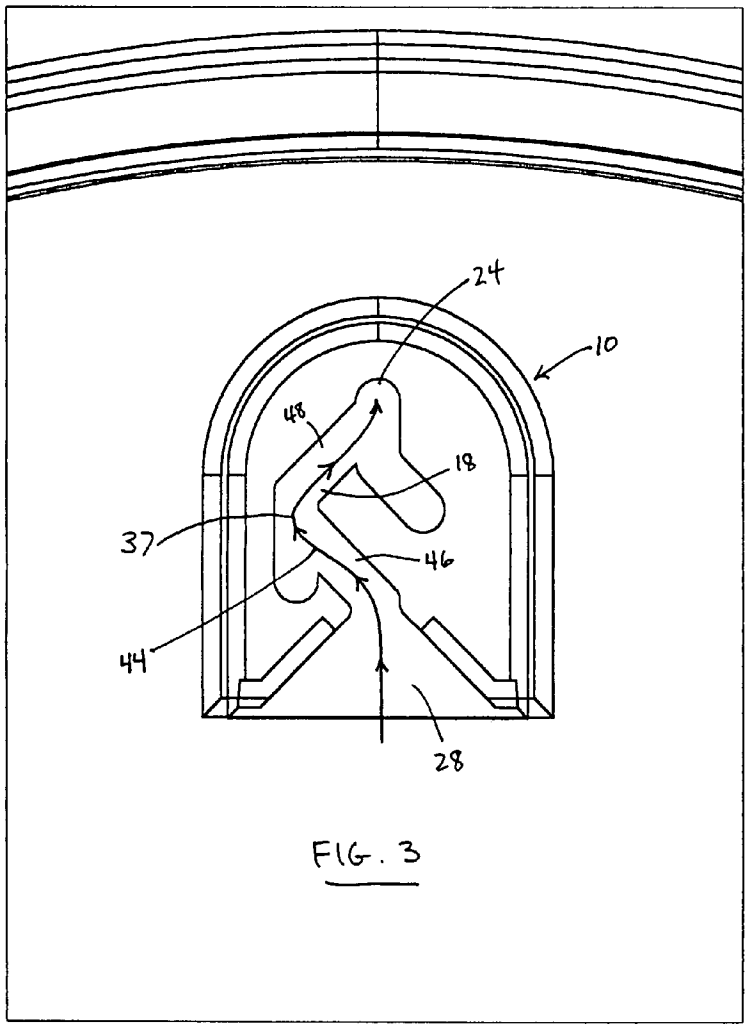
FIG. 3 is a still further magnified view of the top maze lock hanger of FIG. 1.

Referring to FIG. 3, an entry path 44 for the projection 38 into the top maze lock hanger 10 is shown. The projection 38 enters the top maze lock hanger 10 at the receiving area 28, travels up a first leg 46 of the slot 18, up a second leg 48 of the slot 18 and stops at the first end 24 of the slot 18. The first end 24 of the slot 18 rests on the projection 38, thereby mounting the clock 14 to a wall or other substantially vertical surface appropriate for mounting the clock 14.

Referring to FIG. 3, it can be seen that the entry path 44 is the only direct route 37 the projection 38 may take to the first end 24 of the slot 18.

Figure 4:
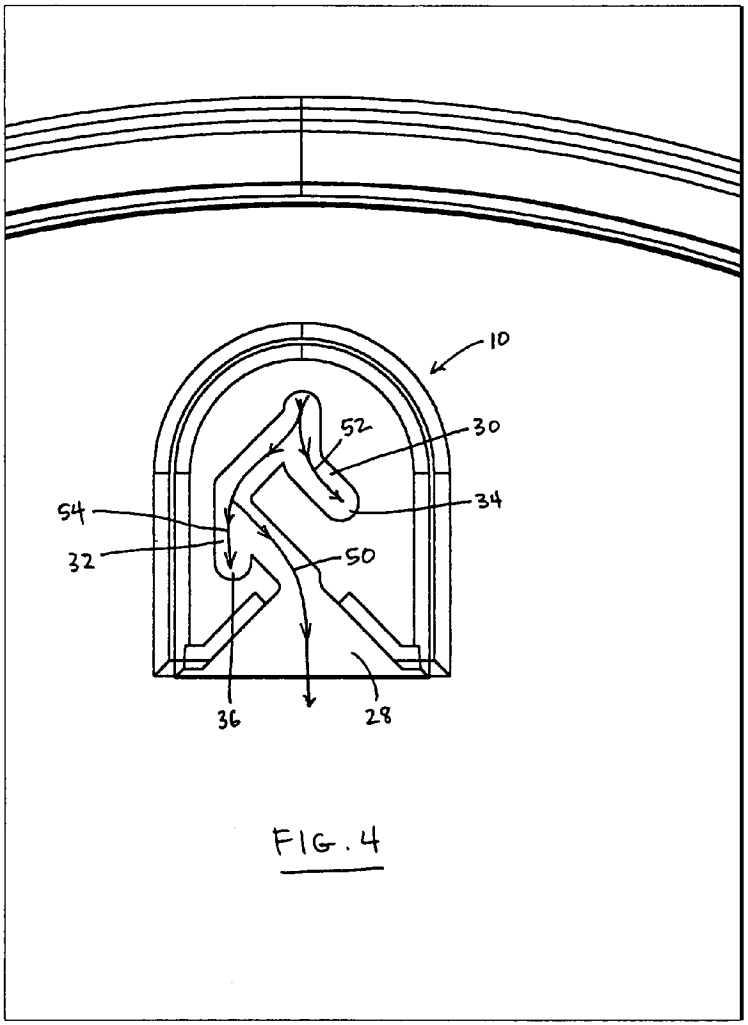
FIG. 4 is a view similar to FIG. 3.

Referring to FIG. 4, upon removal of the clock 14 from a wall, the projection 38 may travel along a removal path 50 or may take one of two dead end paths 52, 54. Moving the projection 38 through the removal path 50 allows the top maze lock hanger 10 to be removed from the projection and, thus, the clock 14 to be removed from the wall. However, moving the projection 38 along the first dead end path 52 results in the projection 38 encountering the first dead end 34, preventing the top maze lock hanger 10 from being removed from the projection 38. Similarly, moving the projection 38 through the second dead end path 54 causes the projection 38 to encounter the second dead end 36, also preventing removal of the top maze lock hanger 10 from the projection 38. Thus, unless a user of the clock 14 has knowledge about the proper path through which the projection 38 should be moved to remove the top maze lock hanger 10 from the projection 38, he or she will likely encounter either the first or second dead end 34 or 36 and be prevented from removing the clock 14 from the wall. It is worth noting that FIGS. 3 and 4 illustrate the top maze lock hanger 10 from the back face 12 of the clock 14. A person attempting to remove the clock 14 from a wall will, of course, be viewing the clock 14 from the front face of the clock 14 opposite the back face 12 and, therefore, will not be able to see the route the projection 38 is taking through the top maze lock hanger 10. Only a user who has knowledge of the top maze lock hanger 10, its slot 18, and first and second slot branches 30 and 32 will be able to intentionally remove the projection 38 through the proper removal path 50 to remove the clock 14 from the wall.

As mentioned above, the top maze lock hanger 10, shown in FIGS. 3 and 4, can be used alone according to the present invention. However, as shown in FIG. 5, if both a top maze lock hanger 10 and bottom maze lock hanger 16 are utilized (see FIG. 1 also), the slot 18 and slot branches 30 and 32 of the top maze lock hanger 10 and bottom maze lock hanger 16 are preferably mirror images of each other because rotational movements of the clock 14 effect movement of the projection 38 within the slot 18 in one direction in the top maze lock hanger 10 and in an opposite direction in the bottom maze lock hanger 16.

Referring to FIGS. 7 and 8, the clock 14, including the top maze lock hanger 10 and bottom maze lock hanger 16 according to the present invention, is mounted on two projections 38 by positioning the clock perpendicular to the wall with the bottom maze lock hanger 16 closest to the wall. As shown if FIG. 8, the clock 14 is then rotated up in a direction 56 so that the back face 12 is adjacent the wall. The projections 38 naturally follow the entry path 44 (see FIG. 3), resulting in the projections supporting the first end 24 of the slot 18 (see FIG. 3) of both the top maze lock hanger 10 and the bottom maze hanger 16. Of course, other steps may be taken to properly mount the top maze lock hanger 10 and the bottom maze lock hanger 16 on the projections 38.

Figure 5:
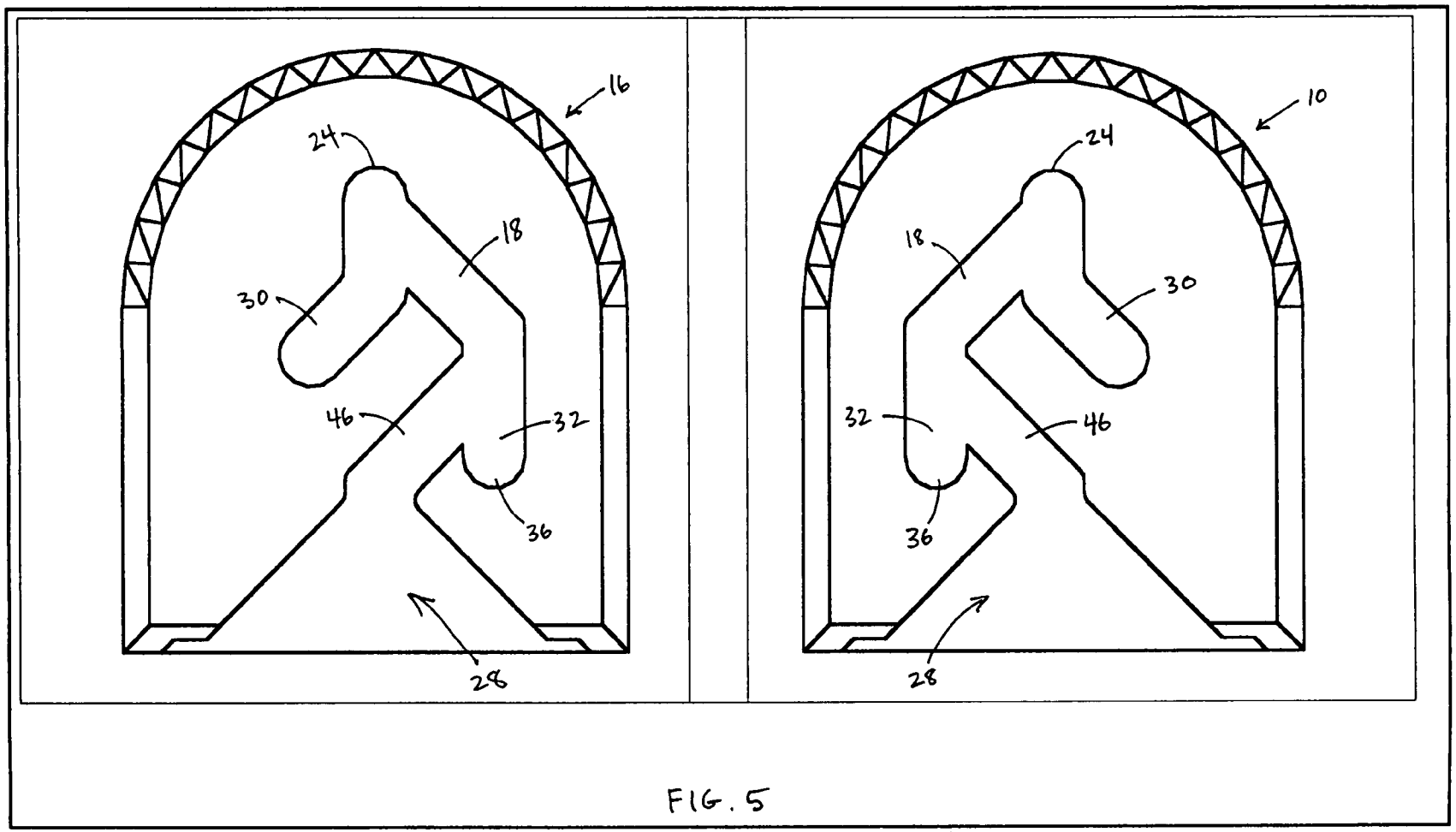
FIG. 5 is a magnified view of the bottom maze lock hanger of FIG. 1 shown side-by-side with the top maze lock hanger of FIG. 1.
Figures 9A, 9B, 9C, 9D, 9E:
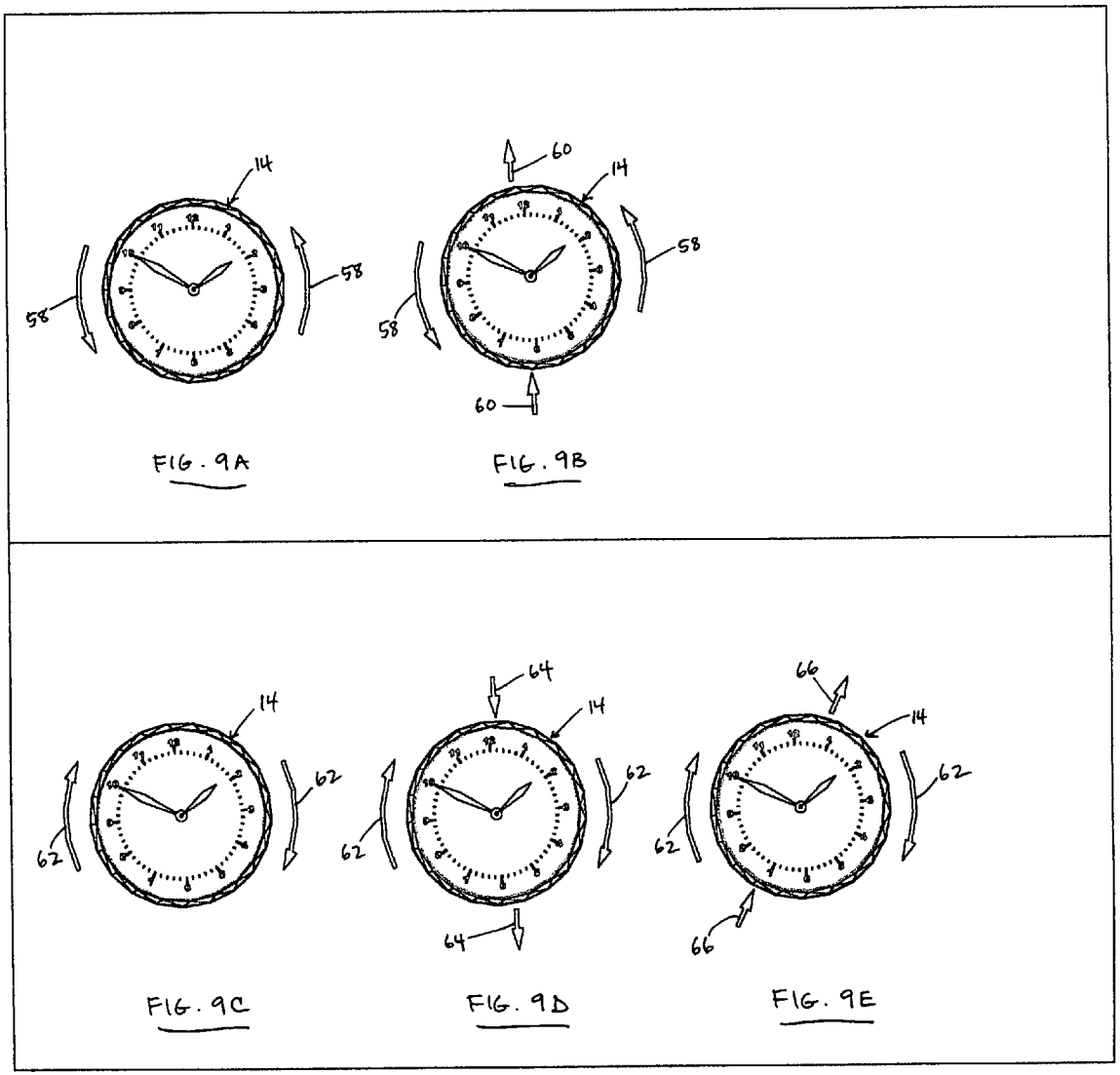
FIGS. 9A, 9B, 9C, 9D, and 9E illustrate a method of removing from a substantially vertical surface a clock molded to include the top and bottom maze lock hangers of FIG. 1.

FIGS. 9A, 9B, 9C, 9D, and 9E illustrate the sequence of movements from the perspective of the front face of the clock 14 that effect removal of the clock 14 from the projections 38, given the configuration of the slot 18 and slot branches 30 and 32 depicted in FIG. 5. As shown in FIGS. 9A and 9B, the clock 14 is first rotated in a counter clockwise direction 58, while being slightly lifted in an upward direction 60. Referring to FIG. 5, this results in the projections 38 travelling from the first end 24 of the slot 18 to the second dead end 36 in both the top and bottom maze lock hangers 10 and 16. Referring back to FIGS. 9C, 9D and 9E, the clock 14 is then rotated slightly in a clockwise direction 62 and lowered slightly in a downward direction 64, before being lifted in a direction 66 off of the projections 38. Referring to FIG. 5, it can be seen that this movement results in the projections 38 travelling up and out of the second dead end 36 of the top and bottom maze lock hangers 10 and 16 and down the first leg 46 of the slot 18 so that the projections 38 are positioned in the receiving area 28, where the head portions of the projections 38 are free to be removed from the top and bottom maze lock hangers 10 and 16.

It will be readily understood by those of ordinary skill in the art that, according to the present invention, other configurations of slots and slot branches can be formed to create simpler or more complex maze configurations, necessitating different sequences of steps for removing a clock or other object from a projection on a wall.

Further, referring again to FIGS. 1 and 2, the top maze lock hanger 10 or bottom maze lock hanger 16, or both, may optionally include flanges 68 that flank the receiving area 28 and converge in on one another. Referring to FIG. 2, the flanges 68 are closest together at the second end 26 of the slot 18. If the head portion 42 of the projection 38 is wider than the distance between the flanges 68 at their closest point, the head portion 42 will need to "snap" through the flanges 68 as the shaft portion 40 of the projection 38 enters the slot 18. The flanges 68 are flexible enough that the head portion 42 of the projections 38 will "pry" the flanges 68 apart as the head portion 42 is wedged through the flanges 68.

Once the head portion 42 has passed through the flanges 68, the flanges 68 will flex back to their original position and the head position 42 will be trapped in the chamber 43 behind the flanges 68. In this way, the flanges 68 serve as a "lock" preventing the removal of the projection 38 from the slot 18. This "locking" feature can be used in conjunction with a straight slot, as well as slots with a maze configuration such as the slot 18.

Although the invention has been described in detail with reference to certain preferred embodiments, variations and modifications exist within the scope and spirit of the invention as described and defined in the following claims.

The invention claimed is:

1. An electronic device for mounting on a substantially vertical surface, the electronic device comprising:

a front face, the front face including a display;

a back face opposite the front face, the back face lying in a substantially vertical plane;

a top hanger formed on the back face, the top hanger including a substantially vertical hanger face and a nonlinear top slot formed in the hanger face, the hanger face at least partially defining a receiving area, the top slot having a substantially constant width and a first, closed end and a second, opened end, the second end opening into the top receiving area which is at least twice as wide as the top slot; and a bottom hanger coupled to the back face and spaced apart from the top hanger, wherein the bottom hanger includes a nonlinear bottom slot having a substantially constant width substantially equal to the width of the top slot and a first, closed end and a second, opened end, the second end opening into a bottom receiving area that is at least twice as wide as the bottom slot.

2. The electronic device of claim 1, wherein both the top slot and the bottom slot make at least one change of direction of greater than 45 degrees and the degree to which the top slot makes a change of direction is substantially equal to the degree to which the bottom slot makes a change of direction.

3. The electronic device of claim 2, further comprising slot branches extending from both the top slot and the bottom slot, each slot branch having a width substantially equal to the width of the top and bottom slots and terminating in a closed end.

4. The electronic device of claim 1, further comprising slot branches extending from both the top slot and the bottom slot, each slot branch having a width substantially equal to the width of the top and bottom slots and terminating in a closed end.

5. The electronic device of claim 4, wherein the bottom slot and the slot branches extending from it are substantially a mirror image of the bottom slot and the slot branches extending from it.

6. The electronic device of claim 1, wherein the top slot opens into the top receiving area in the same direction as the bottom slot opens into the bottom receiving area.

7. A hanger for supporting a device, the hanger comprising:

a housing having a hanger face positioned substantially vertically, the hanger face being spaced-apart from a back face of the device by a sidewall;

a chamber formed behind the hanger face and substantially surrounded by the sidewall;

a nonlinear slot cut into the hanger face, the slot lying substantially in a vertical plane defined by the hanger face and opening at one end into a receiving area; and at least two flanges, one on each side of the receiving area and angled in toward the open end of the slot.

8. The hanger of claim 7, wherein the at least two flanges extend from the sidewall and are in planes that are substantially perpendicular to the hanger face.

9. The hanger of claim 8, wherein the at least two flanges angle in toward each other and at their closest point are spaced apart a distance approximately equal to the width of the open end of the slot.

10. The hanger of claim 7, wherein the at least two flanges extend from the hanger face and are in planes that are substantially perpendicular to the hanger face.

11. The hanger of claim 7, wherein the hanger is engageable with a projection extending outwardly from a wall, and wherein the slot defines an entry path for the projection, an exit path for the projection, and at least one locking path for the projection, the locking path being different than the exit path.

12. The hanger of claim 11, wherein the slot includes a first closed end and a second closed end, and wherein the locking path extends between the first closed end and the second closed end.

13. The hanger of claim 12, wherein the exit path extends between the first closed end and the one end, and wherein the entry path extends between the one end and the first closed end.

14. The hanger of claim 11, wherein the exit path includes at least one change of direction along the nonlinear slot.

15. The hanger of claim 14, wherein the change of direction is at least about 45 degrees.

16. A hanger for supporting a device, the hanger comprising:

a housing having a face positioned substantially vertically;

a nonlinear slot cut into the face, the slot having a first end and a second end, the first end being closed and the second end being opened; and slot branches diverging from the slot and terminating in closed ends, wherein the hanger is engageable with a projection extending outwardly from a wall, and wherein the slot defines an entry path for the projection, an exit path for the projection, and at least one locking path for the projection, the locking path being different than the exit path, wherein the slot includes a third, closed end, and wherein the locking path extends between the first, closed end and the third, closed end, and wherein the exit path extends between the first, closed end and the second, opened end, and wherein the entry path extends between the second, opened end and the first, closed end.

17. The hanger of claim 16, wherein the exit path includes at least one change of direction along the nonlinear slot.

18. The hanger of claim 17, wherein the change of direction is at least about 45 degrees.

* * * * *